United States Patent [19]

Batt

[11] Patent Number: 4,754,579

[45] Date of Patent: Jul. 5, 1988

[54] HAND-HELD POWER FILE WITH DUST EXTRACTION ARRANGEMENT

[75] Inventor: Dennis M. Batt, Bishop Auckland, England

[73] Assignee: Black & Decker Inc., Newark, Del.

[21] Appl. No.: 909,283

[22] Filed: Sep. 18, 1986

[30] Foreign Application Priority Data

Sep. 23, 1985 [GB] United Kingdom ..... 8523451

[51] Int. Cl.[4] ..... B24B 23/06

[52] U.S. Cl. ..... 51/170 EB; 51/273

[58] Field of Search ..... 51/170 EB, 170 R, 273

[56] References Cited

U.S. PATENT DOCUMENTS 2,865,143 12/1958 Goldsmith ..... 51/273
3,824,745 7/1974 Hutchins .
3,938,283 2/1976 Keith .
4,368,597 1/1983 Fleckenstein ..... 51/170 EB
4,411,106 10/1983 Fleckenstein et al. ..... 51/170 EB

FOREIGN PATENT DOCUMENTS 823199 11/1959 United Kingdom ..... 51/170 EB
2082487 3/1982 United Kingdom .

*Primary Examiner*—Roscoe V. Parker
*Attorney, Agent, or Firm*—Edward D. Murphy; Harold Weinstein; Edward D. C. Bartlett

[57] ABSTRACT

A hand-held power file has an abrasive belt trained around spaced apart drive and idler pulleys. The drive pulley is located in a chamber and mounted upon an armature shaft of an electric motor. Also mounted upon the armature shaft is a fan that, in use, creates an air flow through the chamber to remove dust debris from the belt. The abrasive belt extends through an opening at the front of the tool's housing and which also serves as an inlet for the air flow. A bag, for receiving dust entrained in the air flow, is supported by outer and inner supports and fits over an outlet nozzle extending from the chamber.

20 Claims, 12 Drawing Sheets

HAND-HELD POWER FILE WITH DUST EXTRACTION ARRANGEMENT

FIELD OF THE INVENTION

This invention relates to hand-held power tools, and has particular reference to hand-held power tools in which a narrow belt faced with an abrasive material is driven between supporting rollers and is used to abrade the surface of a workpiece.

BACKGROUND OF THE INVENTION

During the use of abrasive belt tools, considerable volumes of dust are emitted and unless suitable measures are taken, the dust escapes into the atmosphere and may create an inconvenience to a user of the tool.

It has been proposed in U.S. Pat. No. 4,411,106 to divert part of the output of a pneumatically powered belt driving motor through a restricted passage to create a low pressure zone adjacent a chamber containing a belt driving pulley and thereby to produce an air flow through the chamber. Such an arrangement is applicable only to a pneumatically powered motor and the effectiveness of the air flow through the chamber is limited by the degree of low pressure that can be created.

SUMMARY OF THE INVENTION

It is an object of the present invention to provide a power file with an effective manner of creating an air flow for dust extraction.

According to the present invention, a power tool comprises driving means, a drive pulley drivable by the driving means, an idler pulley rotatably mounted upon one end of an arm assembly extending away from the drive pulley, an abrasive belt trained round the drive and idler pulleys, and the drive pulley being housed in a chamber having an inlet and an outlet and containing means for inducing air flow from the inlet to the outlet.

The air flow inducing means may comprise a fan. The fan may be driven by the driving means. The drive means may be an electric motor and the drive pulley may be mounted upon the armature shaft of the motor. The fan may also be mounted upon the armature shaft.

Preferably the fan is mounted upon the shaft between the drive pulley and the motor.

The inlet may be of open channel configuration, the arm assembly extending through the channel.

There may also be located in the channel a guide for receiving an inner end of the arm assembly, and in which means are provided for resiliently biassing the arm assembly away from the drive pulley in a manner such as to apply tension to the belt, there being a mechanism for selectively restraining the arm against movement under the influence of the biassing means and moving the assembly towards the drive pulley to relieve the tension in the belt. The mechanism may comprise a cam and follower arrangement.

The drive pulley is preferably located in the air flow.

A debris collecting bag assembly may be detachably connected to a housing of the tool. This assembly may comprise a bag pervious to the passage of air but impervious to the passage of debris to be collected, the bag having a debris inlet, an inner support member inside the member and an outer support member secured to the inner member, and a part of the bag being located between the inner and outer support members, the outer support member having an outlet aligned with the debris inlet of the bag.

The outer and inner support members may be formed with interengaging means which locate the members with respect to one another and hold them together. The outer support member may have extensions by which the bag assembly is securable to a power tool.

Other objects, features, and advantages of the present invention will become more fully apparent from the following detailed description of the preferred embodiment, the appended claims and the accompanying drawings.

DETAILED DESCRIPTION OF THE PREFERRED EMBODIMENT

Figure 1:
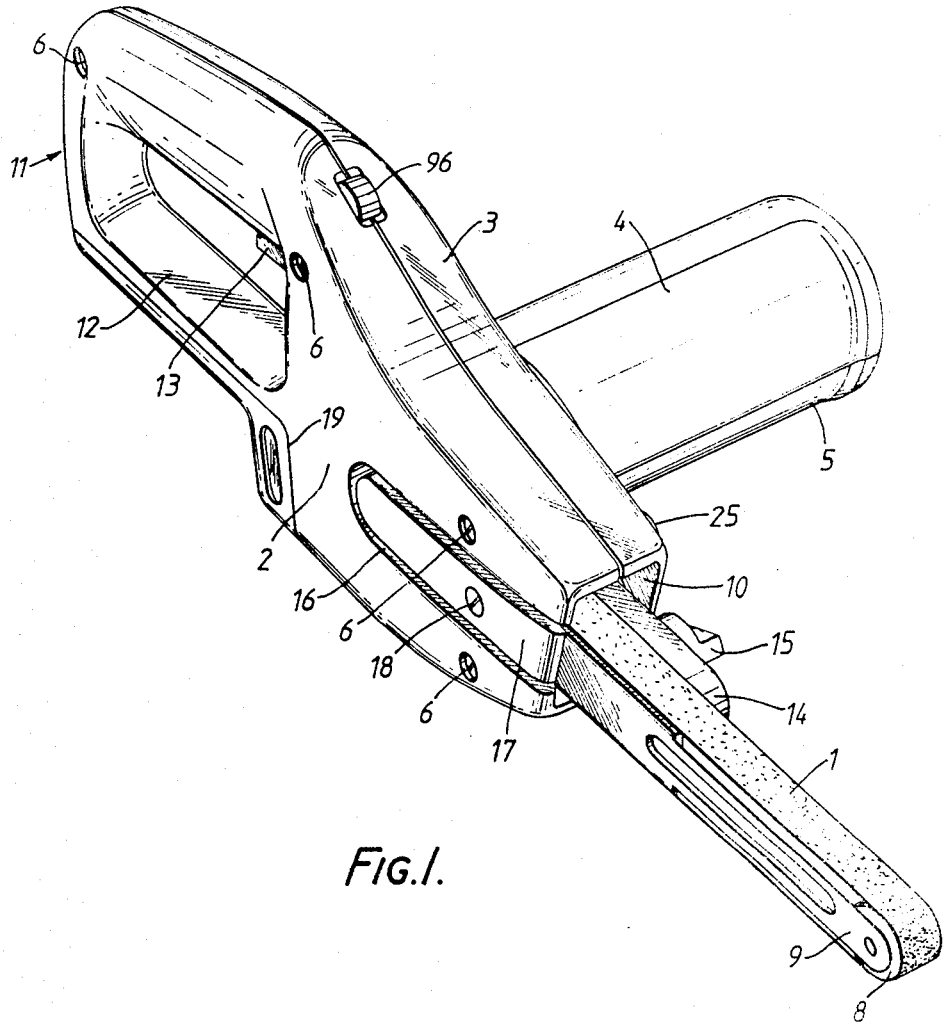
FIG. 1 is a perspective view of a hand-held tool embodying the invention, one part having been removed.
Figure 2:
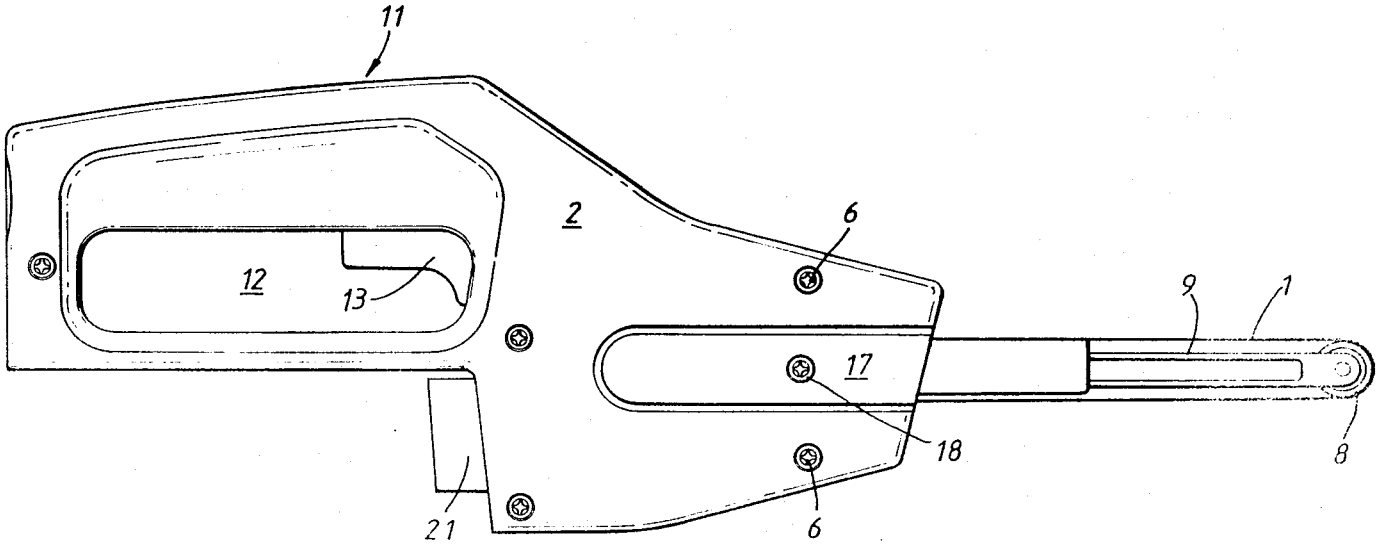
FIG. 2 is a view from one side of the tool.
Figure 3:
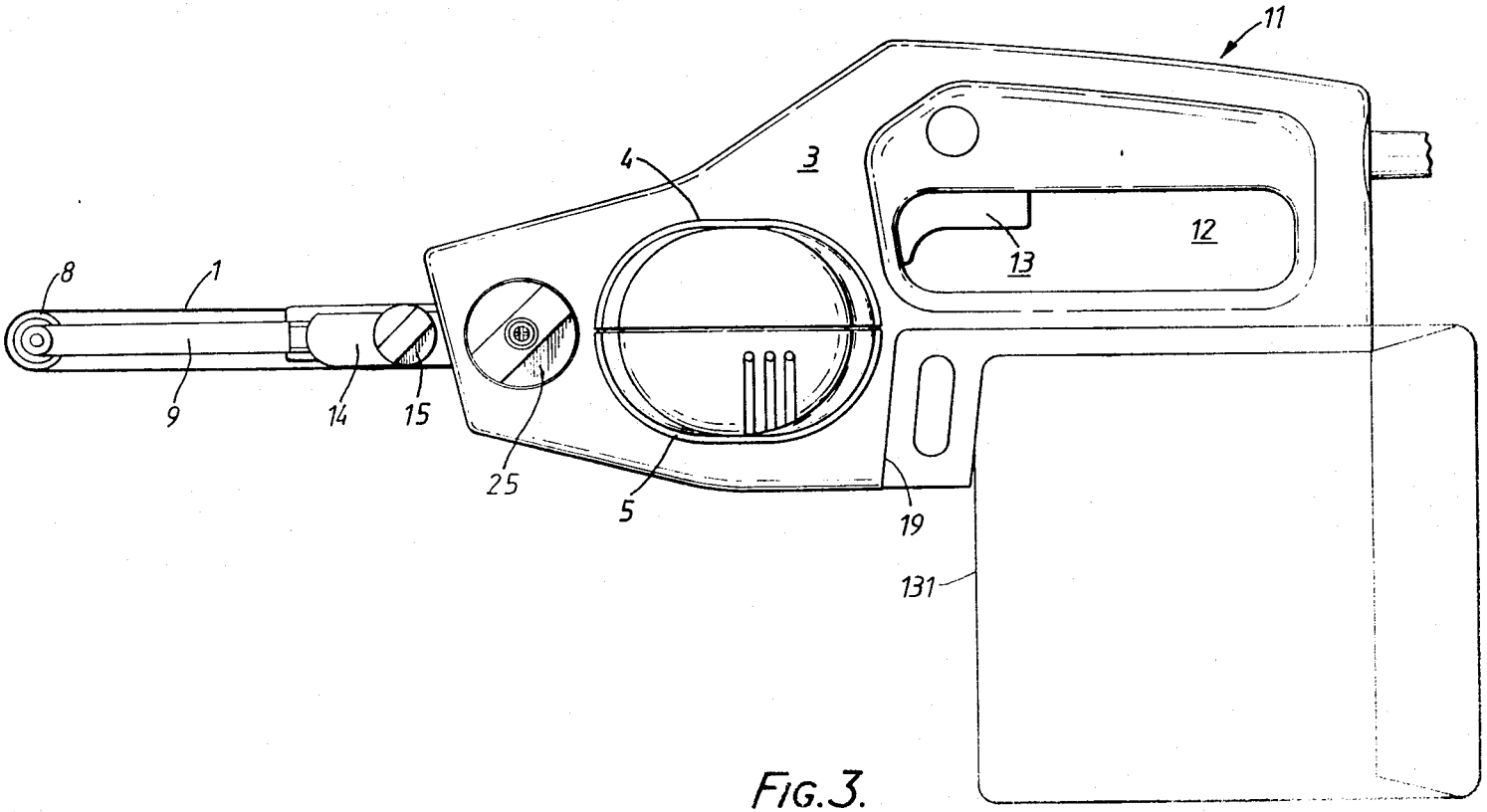
FIG. 3 is a view from the other side of the tool with the missing part attached.

The hand tool shown in FIGS. 1 to 3 can be classed as a hand-held powered file because it comprises a narrow, continuous belt 1 faced with an abrasive material that acts like a file and is driven by an electric motor housed within the tool.

The tool housing is of the so called clam shell construction and it comprises body halves 2, 3 of a suitable plastics material and motor housing halves 4, 5 of a similar material. The edges of the halves are of a mating configuration and are held together by screws. FIG. 1 shows screws 6 that hold together the body halves 2, 3.

The belt 1 passes around a guide roller 8 rotatably mounted at one end of a support arm 9 that extends from the body of the tool. The width of the belt 1 is substantially equal to that of the roller 8 and the arm 9.

The arm 9 extends back into the tool housing through an aperture 10 formed between the halves 2, 3 and is supported therein in a manner described in detail below.

The body halves 2, 3 are adapted to provide a rear handle grip 11 with an opening 12 at the forward end in which is located a trigger 13 that operates an electric switch controlling the supply of electricity to a driving motor housed within the halves 4, 5.

Also extending from the aperture 10 is a support structure 14 to be described in detail below and which supports a shaft carrying a control knob 15 operable by a user to control, in a manner to be described below, the inclination of the arm 9.

The dimensions (as viewed in FIG. 1) of the aperture 10 are considerably greater than the corresponding overall dimension of the arm 9 with the belt 1 and the support structure 14.

Body half 2 is cut away as at 16, the space formed thereby being closed to a large extent by a cover piece 17 held in place by a screw 18.

The body halves 2, 3 are stepped as at 19 to accommodate a frame 111 (see FIGS. 26 and 28) beneath the handle 11. The stepped parts 19 of the halves 2, 3 are formed to provide a nozzle 21 which fits into a correspondingly shaped aperture in the frame 111. The frame 20 has been omitted from FIG. 2 to reveal the nozzle 21.

Figure 9:
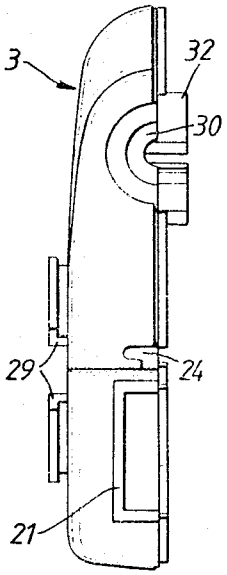
FIG. 9 is an end view of the clam shell half of FIG. 8.

The underneath face of the lower portion of the handle 11 has spaced longitudinal grooves 24 of generally T shape as can be seen from FIG. 9.

Extending from the casing is a second control knob 25 actuable by a user to release the tension in the belt 1 in a manner to be described below. The body halves 2, 3 are shaped to accommodate part of the body of the knob as will be described below.

The clam shell halves 2, 3 are shown in more detail in FIGS. 8 to 11.

Figure 8:
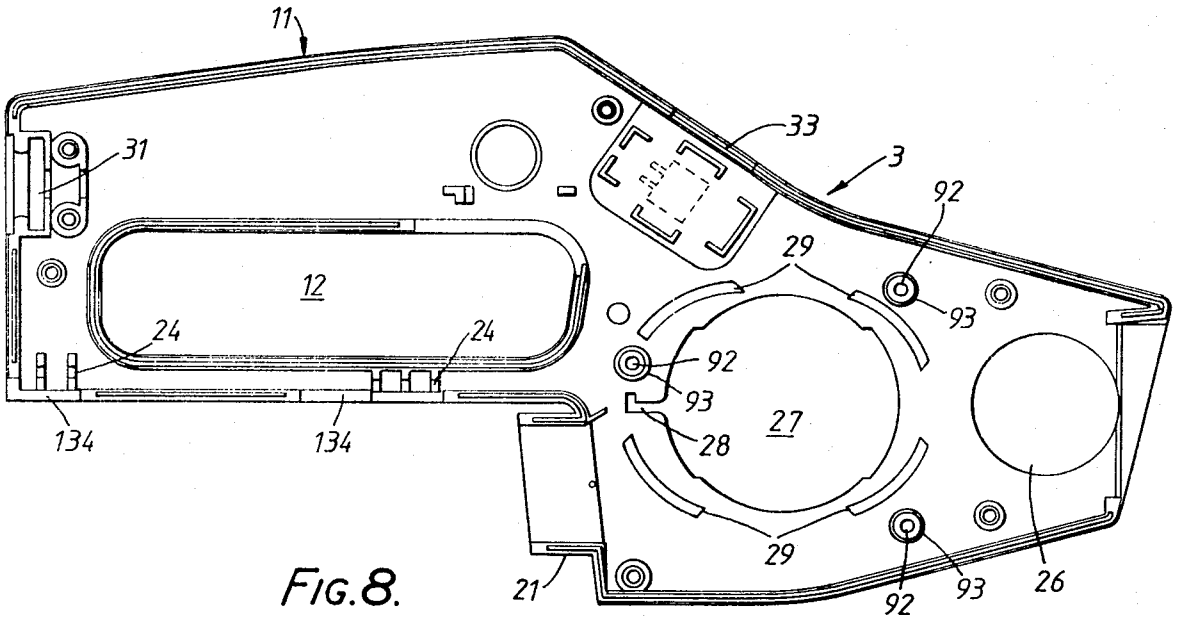
FIG. 8 is a side view of a body clam shell half.
Figure 11:
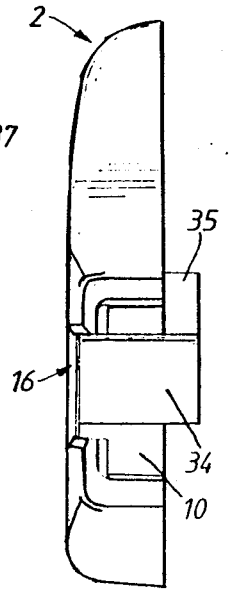
FIG. 11 is an end view of the clam shell half of FIG. 10.

FIG. 8 shows the inside face of half 3. This half has a hole 26 in which the knob 25 locates and a further and larger hole 27 with a small cut-away 28 leading from it. Surrounding the hole 27 on the outside face of the half 3 are four curved spaced brackets 29. The rear of the half 3 is cut away as at 30 to receive a cable guard indicated at 31 in FIGS. 4 and 5. Adjacent the cut-away 30, the half is contoured at 32 to receive a cable clamp. A further cut-away 33 accommodates a speed control knob referred to below.

Figure 10:
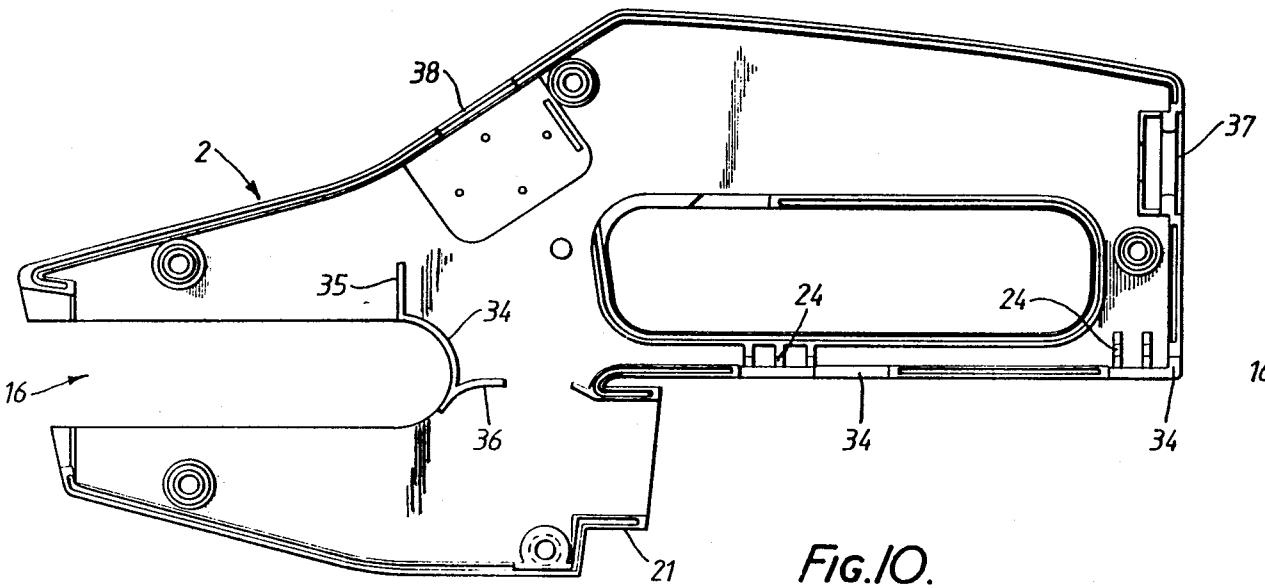
FIG. 10 is a side view of another clam shell half.

FIG. 10 shows the inside face of clam shell half 2 and shows the cut-away 16. As can be seen, the inner end of the cut-away 16 is semi-circular and around part of the inner end is a wall 34 having extensions 35 and 36. The function of the wall 34 and its extensions 35, 36 will be described below. Half 2 is also cut away as at 37 and 38 to receive the cable guard 31 and the speed control knob.

FIGS. 12 to 17 show the halves of the motor casing in more detail.

Figure 12:
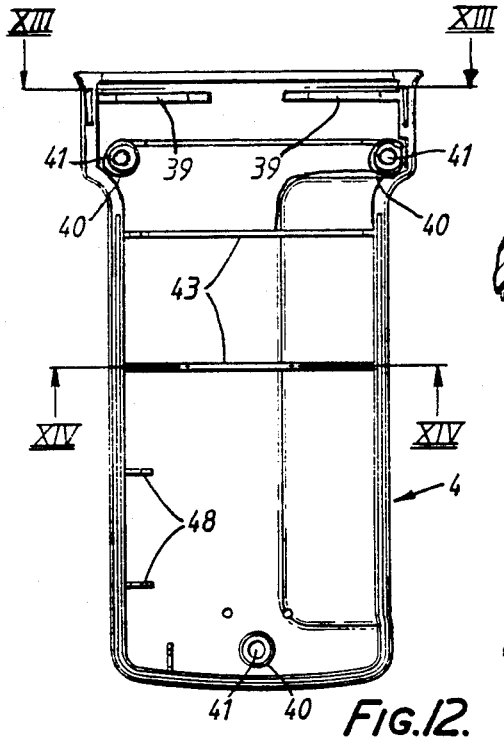
FIG. 12 is a side view of a motor casing clam shell half.
Figure 13:
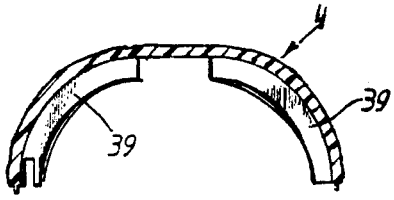
FIGS. 13 and 14 are respectively sections on the lines XIII—XIII and XIV—XIV of FIG. 12.
Figure 14:
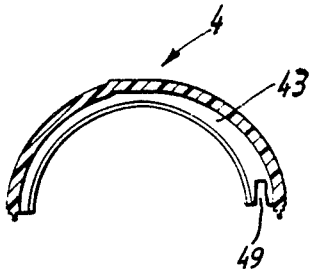

FIGS. 12 to 14 show the top half 4 and the formation on the inner surface thereof of two flanges 39 adjacent the upper end (as viewed in FIG. 12) which co-act with two of the brackets 29 to hold the half 4 against the body half 3. This half 4 also has projecting bosses 40 with screw holes 41. The half also has internal ribs 43 contoured to receive a cylindrical motor unit described below. As can be seen from FIG. 14, the ribs 43 are slightly off-center with respect to the axis of the half 4.

Figure 15:
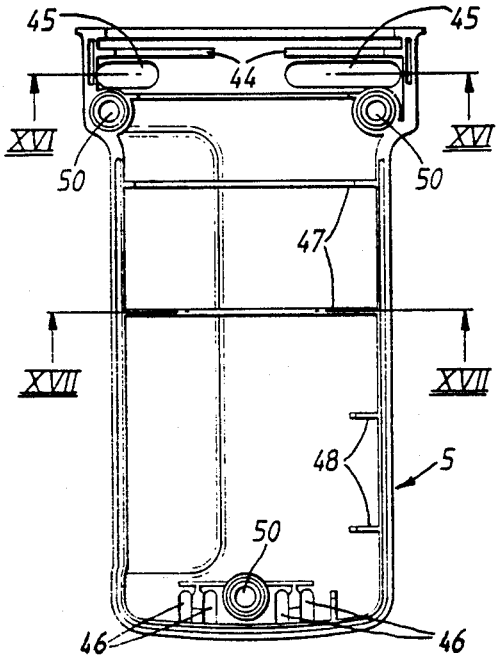
FIG. 15 is a side view of another motor body clam shell half.
Figure 16:
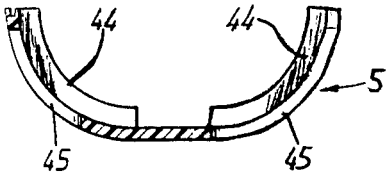
FIGS. 16 and 17 are sections respectively on the lines XVI—XVI and XVII—XVII of FIG. 15.
Figure 17:
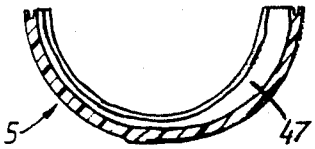

FIGS. 15 to 17 show the other lower half 5 of the motor casing. This half also has two flanges 44 which cooperate with the other two of the brackets 29 to hold half 5 against body half 3. Adjacent the flanges 44, are air exit slots 45, air inlet slots 46 being formed at the other end of the half 5. Half 5 also has internal ribs 47 disposed with respect to the axis of the half 5 in a manner similar to that of the ribs 43 with respect to half 4.

Both motor casing halves also have spaced projections 48 aligned with a slot 49 in one end of the ribs 43 of half 4.

After mounting upon the casing half 3, the motor casing halves are secured together by screws that pass through holes 50 in half 5 and into the bores 41 in the bosses 40 in half 4. Securing the halves 4 and 5 together also prevents the flanges 39 and 44 from disengaging the brackets 29.

Mounted inside the motor casing upon the ribs 43, 47 is an electric driving motor 51 (FIG. 4) whose armature shaft 52 is supported by a top bearing plate 53 apertured centrally to receive a bearing through which the shaft 52 extends.

Figure 7:
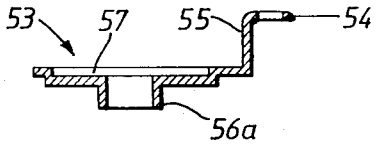
FIG. 7 is a section on the line VII—VII of FIG. 6.
Figure 6:
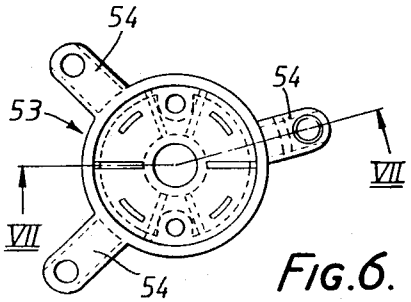
FIG. 6 is a plan view of a component.

The top bearing plate 53 is shown in more detail in FIGS. 6 and 7. It is a light alloy casing of disc-shape with three radially extending arms 54 each with a screw hole by means of which the plate 53 is secured in place in the body half 3. One of the arms includes an upstanding part 55. The screw passing through the screw hole of the latter arm being shown at 56 in FIG. 4. There is a flange 56 around the aperture which supports the bearing. The central area of the plate is recessed as indicated at 57.

Seated upon the plate 53 is a cup-like housing 58 of a plastics material and shown in more detail in FIGS. 18 to 21. The base 59 of the housing 58 is apertured centrally as at 60, the armature shaft 52 passing through the aperture as can be seen from FIG. 4. The upper face of the base 59 has a series of concentric ridges 61. The housing 58 is of volute form with respect to the aperture 60.

The housing 58 has three radially extending arms 62 each of which has a screw hole adjacent its outer end.

The arms 62 are aligned circumferentially with the arms 54 of the bearing plate 53. The arms 62 stem from the curved wall 63 of the housing at points along the height of the latter as can be seen from FIGS. 20 and 21.

The curved wall 63 of the housing 58 is cut away within limits indicated at 64. The cut-away within the limits 64 forms an inlet to the housing 58, the air outlet thereof lying between parallel extensions 63A of the curved wall 63. The upper (as viewed in FIG. 18) one of the extensions 63A has a location tag 63B.

Extending from the housing 58 is an upwardly-open channel having a base 65 with a longitudinal slot 66 and spaced side walls 67 that converge slightly towards the cup-like housing 58 and merge with the wall 63 of part 58.

Extending upwardly (as viewed in FIG. 19) from the base 65 is a tubular guide 68 whose bore 69 is positioned above the base 65 and is closed at one end by a transverse wall 70.

Figure 19:
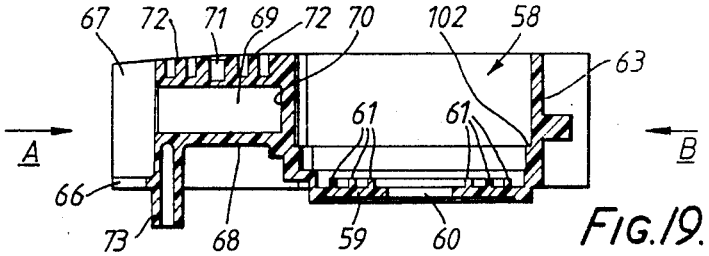
FIG. 19 is a section on the line XIX—XIX of FIG. 18.
Figure 20:
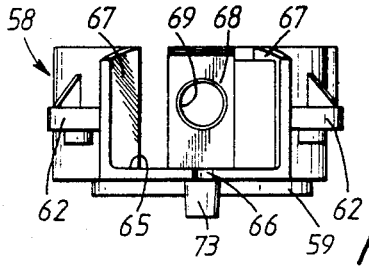
FIGS. 20 and 21 are side views in the directions of arrows A and B respectively in FIG. 19.
Figure 21:
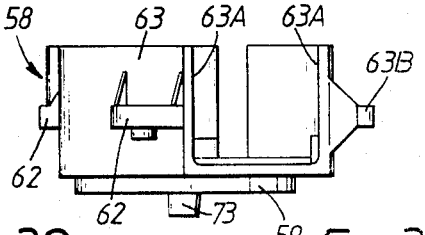
Figure 22:
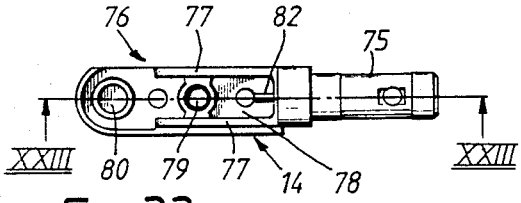
FIG. 22 is a plan view of another component.
Figure 24:
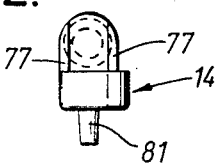
FIG. 24 is an end view of the component of FIG. 22.
Figure 23:
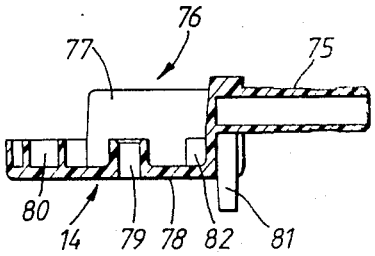
FIG. 23 is a section on the line XXIII—XXIII of FIG. 22.

The upper (as seen in FIG. 19) surface of the guide 68 has a boss 71 apertured to receive the screw 18 referred to above, (on each side of the boss 71, the upper surface has support ribs 72 that support the cover 17). The lower surface of the guide has a downwardly extending rod 73 on which the knob 25 is rotatably mounted and to which it is secured by a screw 74 (FIG. 4) that passes into a bore in the rod 73.

Slidably mounted in the bore 69 is a hollow tubular portion 75 of the support 14 on which the arm 9 is mounted. The portion 75 extends from the body 76 of the support 14, the body 76 having spaced side walls 77 and a base 78 apertured at 79 and having a well-like recess 80. From the base 78 extends a pin 81, that passes through the slot 66 in the base 65 of the member 58 and into a recessed cam track in the inner face of the knob 25. Extending upwardly from the base 78 at one end thereof is a support 82.

Figures 4, 4A:
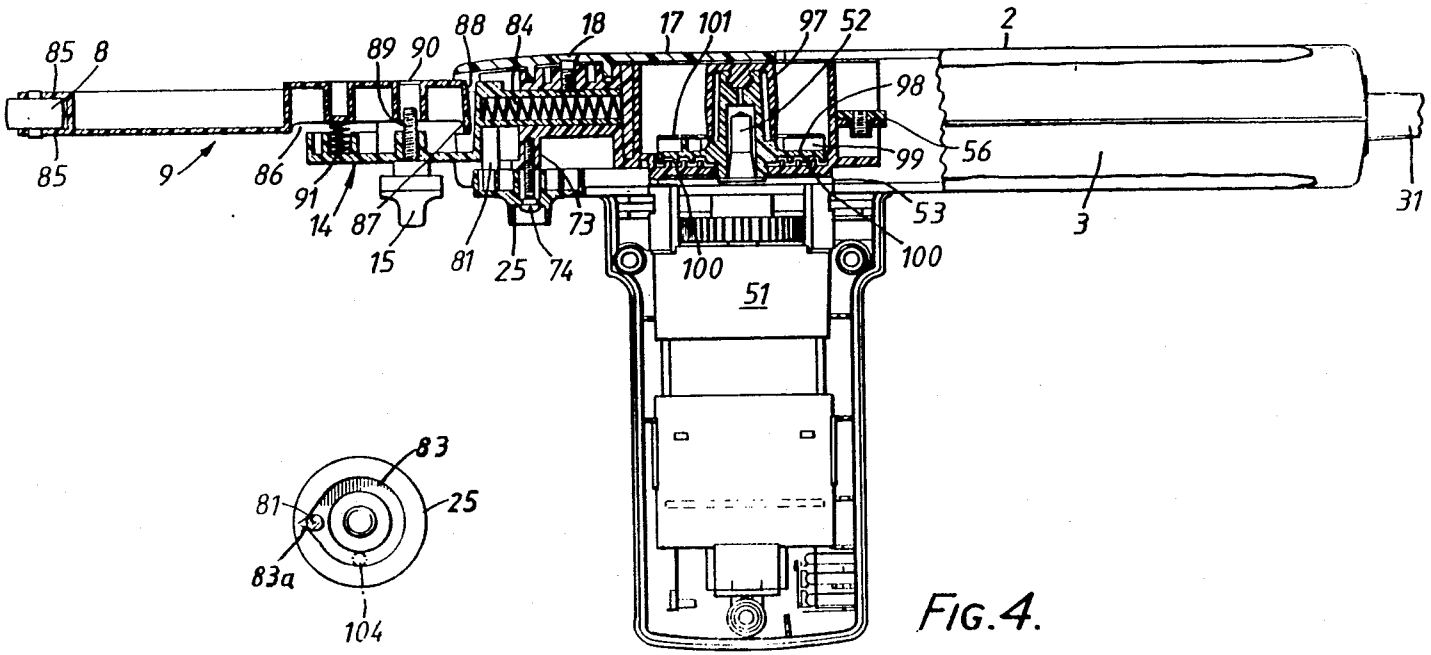
FIG. 4 is a side view partly in section of the tool.
FIG. 4A shows on an enlarged scale a detail of FIG. 4.

FIG. 4A shows the undersurface of the knob 25, the cam track being referenced 83. The contour of the track is such that rotation of the knob about the rod 73 produces movement of the support 14 and arm 9 relatively to the wall 65, i.e., longitudinal movement of the tubular portion 75 in the bore 69. Accommodated in the bore 69 is a helical spring 84 (FIG. 4) that acts between the wall 70 and the closed end of the tubular portion 75. The cam track 83 has a "nose" or widened part **83*a* such that when the knob 25 is rotated to bring the pin 81 in line with part 83*a*, spring 84 urges the support 14 away from the wall 70. As the knob 25 is rotated from the position just described, the part 83*a* moves away from the pin 81 and the cam track acting on the latter causes the support to move towards the wall 70**.

The arm 9 is an elongate structure bifurcated at one end to provide arms 85 between which the roller 8 is rotatably mounted. A cut-away 86 at the other end of the arm provides a lip 87 at this end of the arm, the end face being slightly bevelled as indicated at 88.

The other end of the arm locates between the walls 77 of the support 14 and the arm is secured to the support by means of the screwed shank 89 of the knob 15, the shank passing through the apertures 79 and into a threaded bore 90 in the arm. A spring 91 seated in the recess 80 urges the arm 9 away from the support 14.

To assemble the components described above, the motor 51 is first positioned in the casing half 5 and the necessary electrical connections completed to lead wires that run along the casing half from the motor and upon a ledge (not shown) but supported upon the spaced projections 48, and engaged in the slot 49. The lead wires connect with a control switch within the body halves 2, 3 as will be described below. The casing half 5 is then manipulated to engage the flanges 44 on the lower pair of the brackets 29. The upper motor half 4 is then located in position on the half 5 and with the flanges 47 of half 4 in engagement with the other pair of the brackets 29. Screws passed through the holes 50 into the bores 41 of the bosses 40 secure the halves of the motor casing together and the latter to the half 3.

The top bearing plate 53 is placed over the armature shaft 52, the arms 54 of plate 53 being aligned with holes 92 in bosses 93 in the casing half 3.

The member 58 is then fitted over the plate 53, the armature shaft extending through the aperture 60.

Figure 5:
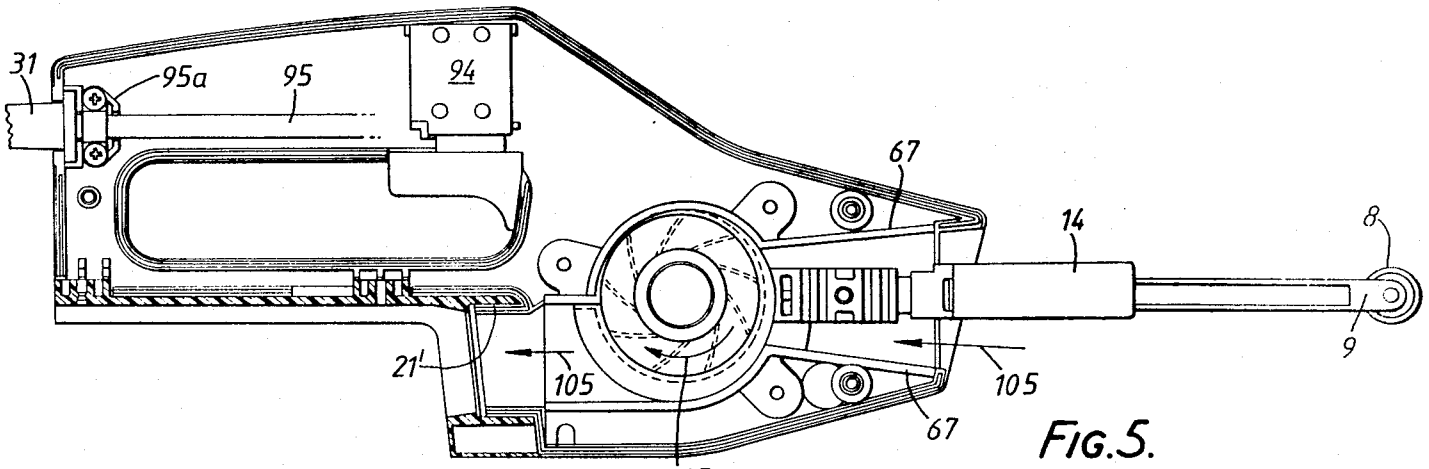
FIG. 5 is a plan view of the tool with a housing part removed.

In addition, the outer ends of the side walls 67 register with the sides of the aperture 10 as can be seen from FIG. 5. There is thus created a passageway leading from the aperture 10 to the space bounded by the walls 67.

During the positioning of the member 58 care is taken to align the arms 62 with the arms 54 thereby enabling securing screws to be passed through the holes in the arms to secure the various components in position.

The helical spring 84 is positioned in the bore 69 of the member 58 after which the tubular portion 75 of the support 14 is inserted into the bore compressing the spring 84. The pin 81 locates in the slot 66 to prevent rotation of the member 58 about its longitudinal axis. The pin 81 also extends into the cam track 83 in the inside face of the knob 25 when the latter is mounted upon the rod 73.

The arm 9 is positioned on the support 14 and the spring 91 is located in the recess 86. The shank of the adjusting knob 15 is then screwed into the bore 90 to hold the arm 9 in position.

At an appropriate stage, an ON/OFF switch indicated as block 94 is located in casing half 3 and connection made thereto from a power cable 95 entered through the cable protector 31 and held by a cable clamp **95*a*. Connection is also made from the motor unit 51** to the switch using the lead wires referred to above.

If desired, a speed control limit adapted to vary the speed of rotation of the shaft 52 of the motor may be fitted. In that case the casing is modified to receive a control knob 96 located, as can be seen from FIG. 1, at the front end of the handle 11.

Secured to the end of the shaft 52 is a combined pulley/fan. The pulley comprises a barrel-shaped structure 97 whose lower (as seen in FIG. 4) end is formed with a disc 98 whose upper surface has curved fan blades 99. The lower surface of the disc 98 has concentric ridges 100 that mesh with the ridges 61 on the upper surface of the base 59 of the member 58.

Figure 18:
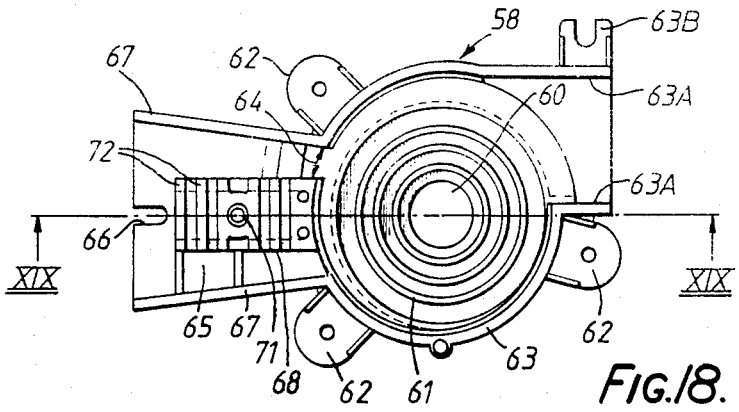
FIG. 18 is a plan view of a component.
Figure 25:
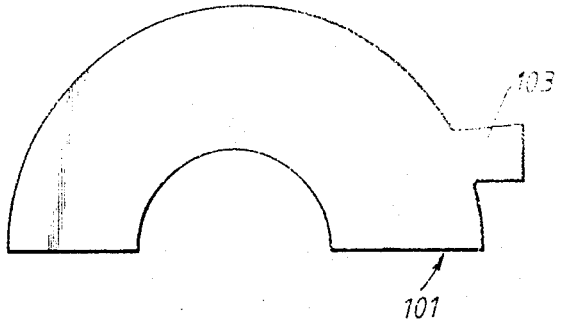
FIG. 25 is a plan view of a further component.

Located just above the upper (as seen in FIG. 4) edge of the fan blades 99 is a partition plate 101 (FIG. 25). The plate 101 is of semi-annular form when seen in plan as in FIG. 25 and seats upon an internal ledge 102 in the member 58. The partition plate 101 has a location tag 103 that ensures correct positioning of the plate and which locates against the lower (as seen in FIG. 18) wall 63A.

The partition plate effectively blanks off one half of the fan blades.

Body half 2 is then placed over body half 3 and the halves are secured together by screws 6. As half 2 locates in position, the extensions 35, 36 blank off a segment of the space between the pulley 97 and the wall 63.

Knob 25 is rotated to bring the pin 81 to the relative position shown dotted at 104 in FIG. 4A and in which the support 14 is moved towards the wall 70.

The abrasive belt 1 is then trained around the structure 97 and the pulley 8 and subsequently the belt 1 is tensioned by adjustment of the position of the support 14 by rotating the knob 25 to the position which the pin 81 lies opposite the part **83*a* and the spring 84 urges the support 14 away from wall 70 so tensioning the belt 1**.

If necessary, correct tracking or centralization of the belt 1 upon the roller 8 can be secured by adjusting knob 15 to pivot the arm 9.

During use of the powered file, it is found that some of the debris created by the abrasive action of the belt 1 travels back into the body of the tool on the surface of the return run of the belt. Rotation of the pulley/fan causes the blades 99 to create an air flow that enters the body through the aperture 10, passes along the passageway adjacent the lower of the walls 67 (as seen in FIG. 5) and into the space surrounding the pulley structure 97. That air flow is indicated by arrow 105 in FIG. 5.

As the air flow passes through the passageway it flows over the surface of the belt 1 carrying the debris, some of which is removed thereby. Further debris falls off the belt 1 as it passes around the pulley structure 97. Such debris is entrained in the air flow and is ejected through the nozzle 21.

The fan creates an effective air flow into the aperture 10 thereby withdrawing into that aperture dust and other debris that would otherwise escape into the atmosphere. Additionally, the flow of air over the surface of the belt especially where the latter passes around the pulley structure 97 removes loose dust and debris from the surface of the belt.

Figure 26:
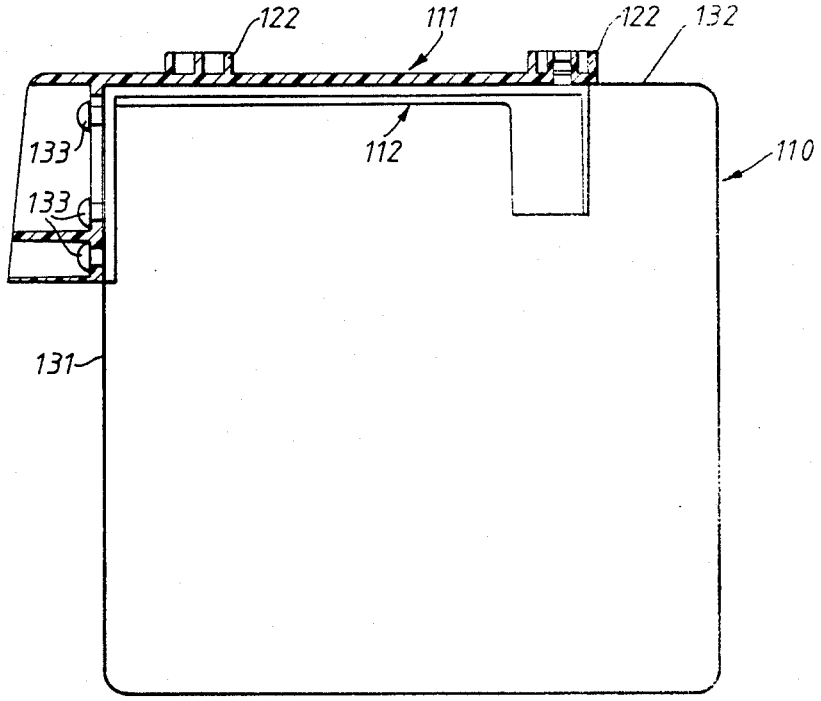
FIG. 26 is a side end view of a debris collecting bag.

Such debris is not discharged into the atmosphere but into a collecting bag 110 shown in FIG. 26 that is attached to the end of the nozzle 21.

The bag 110 is of generally rectangular form when seen in side view as in FIG. 26 and in end view, and is made of a fabric sufficiently closely woven to retain particles of dust projected into the bag without at the same time preventing passage through the walls of the bag of most of the air in which the debris is entrained.

The upper (as viewed in FIG. 26) wall 132 of the bag is clamped between an external support 111 and an internal support 112 which extend along that wall for the greater part thereof. Those supports are of a plastics material.

The external support 111 has a mouth portion 113 (FIG. 28) from which extends a support bar 114. The mouth portion 113 has an opening 115 of generally rectangular form as can be seen from FIG. 29 dimensioned to mate with the nozzle 21 referred to above. Inside the opening 115 is a peripheral flange 116 that is stepped as at 117. There is thus formed a socket which fits over the nozzle 21.

Around the opening 115 is a flange 118 apertured at spaced points as indicated at 119. The flange 118 is, in effect, a continuation of the flange 116 and is bounded by an external wall 120.

Figure 27:
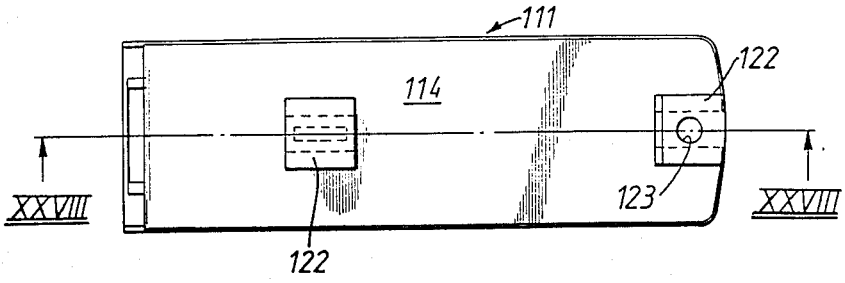
FIG. 27 is a plan view of a part of the bag.
Figure 28:
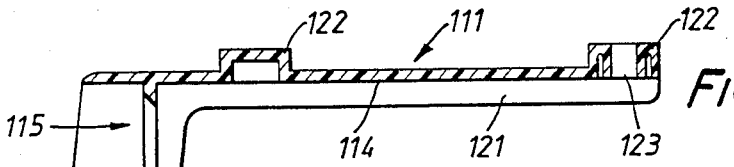
FIG. 28 is a section on the line XXVIII—XXVIII of FIG. 27.
Figure 29:
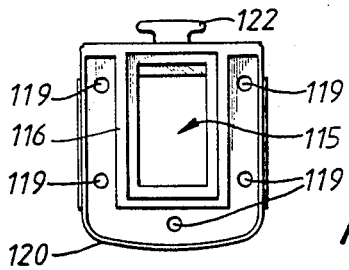
FIG. 29 is an end view of the part of FIG. 27.
Figure 30:
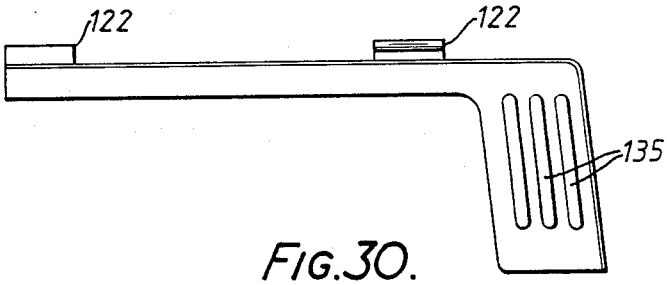
FIG. 30 is a side view of the part of FIG. 27.
Figure 31:
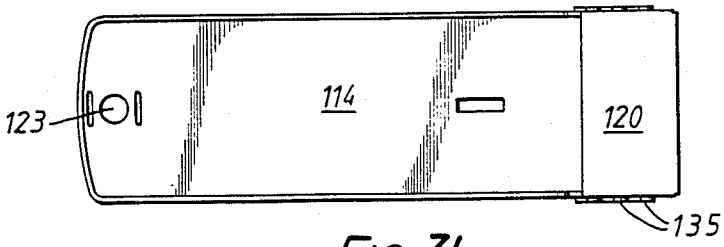
FIG. 31 is a plan view of the part of FIG. 27.
Figure 32:
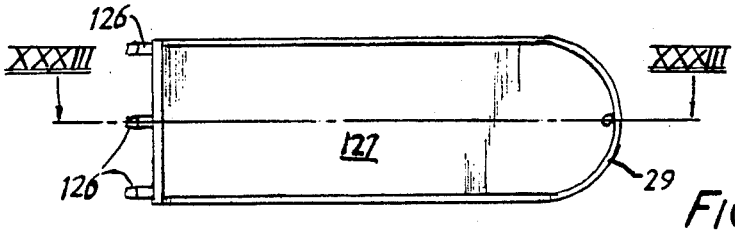
FIGS. 32 and 33 are, respectively, plan and section views on the line XXXIII—XXXIII of FIG. 32 of another part of the bag.

The support bar has side flanges 121 depending from its lateral edges and from the top surface extend guides 122 of T-shaped cross section when seen in end view as in FIG. 27. The right-hand of the guides 119 (as seen in FIG. 28) is apertured centrally as at 123, the apertures also penetrating the support bar.

Figure 33:
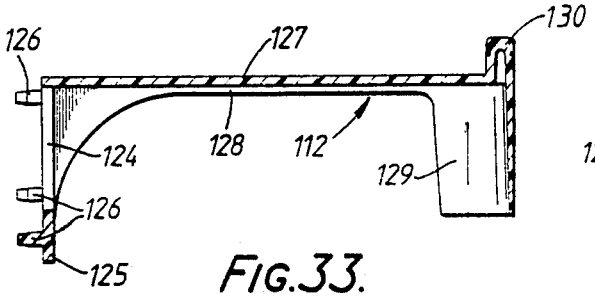
Figure 34:
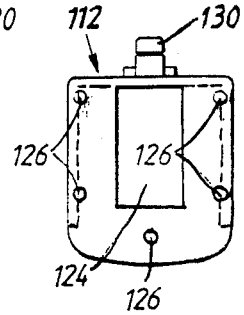
FIG. 34 is an end view of the part of FIG. 32.

The inner support 112, FIGS. 33 and 34, has a mouth 124 dimensioned to mate with mouth 114 and formed in a part 125 that carries integral pins 126 that project forwardly as shown in FIG. 33. Extending from the part 125 is a support bar whose length equals that of bar 114. Bar 127 has show side flanges 128 which merge into a semi-circular end wall 129 of considerably greater depth than the flanges 128. At its distal end, bar 127 has a short upstanding stud 130.

The bag 110 has a mouth in its side wall 131 through which the inner support 112 is passed to lie along the inside of the top wall 132 of the bag. The stud 130 projects through a hole in the top wall 132. When the inner support is correctly positioned inside the bag 110, the mouth portion 124 fits over the mouth of the bag.

The outer support 111 is now slid along the top wall 109 of the bag until the studs 126 enter the holes 119 at which point the stud 130 is entered into aperture 123. The ends of the studs are then "staked" over as indicated at 133 in FIG. 26 and the stud 130 is secured in aperture 123.

To mount the bag on the powered file, the guides 122 are aligned with openings 134 in the halves 2, 3 beneath the handle and are slid along the correspondingly shaped grooves 24 until the mouth 115 fits closely over the nozzle 21. To facilitate handling of the dust bag, the external support 111 has shallow recesses 135 formed on the flanges 120 to enable a user to grip the support.

Having fitted the bag, the powered file can be connected to a power supply and is then ready for use. On depressing the trigger 13, the motor is energized and the pulley structure 97 rotated thereby driving the belt. By applying the moving belt to the surface of a workpiece, abrasion of the surface can be effected. Preferably, contact is made with the return of the belt about midway between pulley 8 and support 14. To provide some additional support for the belt in that contact area, pressure pads 136 may be positioned between the arm 9 and the runs of the belt and the arm. The pads may be of a resilient plastics material and secured to the arm in some suitable way, preferably one that allows the pad to be replaced when necessary.

If, during use, it becomes necessary to replace the belt 1, for example because the latter is worn or has broken, extraction of the screw 18 allows the cover piece 17 to be removed and this gives access to the pulley structure 97. The worn or broken belt can then be removed and a new belt placed in position. If necessary, tension on the belt to be removed is reduced to facilitate removal by rotating the knob 25. After insertion of the new belt, the tension is re-set by suitable rotation of knob 25.

Arms of shapes other than the straight form of arm 9 described above can be used when desired.

Two alternative forms of arm are shown in FIGS. 35, 36 and FIGS. 37, 38.

Figure 35:
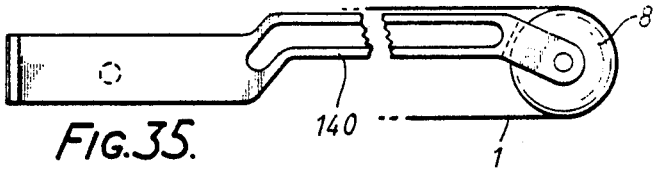
FIGS. 35 and 36 are side views of an alternative form of arm, and is a section on the line XXIX—XXIX.
Figure 36:
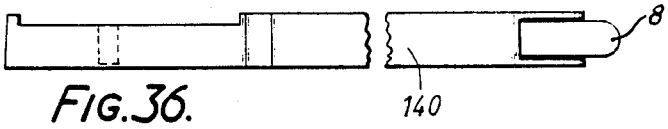

That shown in FIGS. 35 and 36 has a crank portion 140 so creating a large gap between the arms and the adjacent run of the belt.

Figure 37:
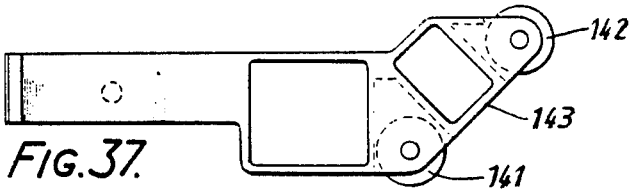
FIGS. 37 and 38 are side views of another form of arm.
Figure 38:
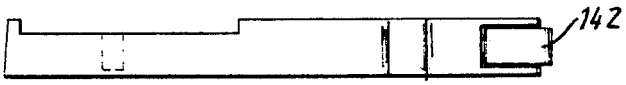

In the form of arm shown in FIGS. 37 and 38, two pulleys 141 and 142 are located at the end of the arm, the outer end of the arm being inclined as at 143. This configuration allows use of the tool in locations that would not be accessible with the arm 9 described above.

Both arms have the lips 87 and threaded bores 90 and are mounted on the support 14 in a manner similar to that of arm 9 described above.

The above described embodiments, of course, are not to be construed as limiting the breadth of the present invention. Modifications, and other alternative constructions, will be apparent which are within the spirit and scope of the invention as defined in the appended claims.

What is claimed is:

1. A power tool, comprising:

a housing;

a motor mounted in said housing;

a drive pulley connected to said motor to be driven thereby;

an arm assembly connected to said housing and extending forwardly therefrom away from said drive pulley;

an idler pulley rotatably mounted on a forward end of said arm assembly;

an abrasive belt trained around said drive and idler pulleys;

a chamber in said housing, said chamber having an air inlet, an air outlet, and containing said drive pulley;

means for inducing an air flow through said chamber from said inlet to said outlet;

said arm assembly extending through said air inlet;

said chamber comprising forward, intermediate, and rear portions;

said rear portion extending forwardly from said outlet to said intermediate portion and being in communication with said intermediate portion;

said intermediate portion having said inducing means therein;

said forward portion communicating with said intermediate portion and extending forwardly therefrom to said inlet; and said forward portion having opposed, spaced-apart side walls extending rearwardly away from said inlet, said side walls converging towards each other from said inlet to said intermediate portion.

2. The power tool of claim 1, further comprising;

a guide in said forward portion between said side walls, a rear end of said arm assembly being movably received by said guide; and resilient means for resiliently biasing said arm assembly away from said drive pulley to apply tension to said belt.

3. The power tool of claim 2, further comprising means for selectively restraining said arm assembly against movement by said resilient means, said selectively restraining means also functioning to selectively move said arm assembly towards said drive pulley to relieve tension in said belt.

4. The power tool of claim 2, wherein said rear end is of tubular form and said guide comprises a cylinder, said rear end being slidably mounted in said cylinder.

5. The power tool of claim 4, wherein said resilient means comprises a spring disposed within said rear end.

6. The power tool of claim 1, wherein said housing has a motor compartment containing said motor and a handle portion extending rearwardly of said motor compartment.

7. The power tool of claim 6, wherein said air outlet is located below said handle portion, and said air inlet is disposed at a forward end of said housing.

8. The power tool of claim 7, wherein said arm assembly and belt extend through a central portion of said air inlet leaving space for passage of air above and below said arm assembly and said belt.

9. The power tool of claim 1, wherein said inducing means comprises a fan connected to said motor to be driven thereby.

10. The power tool of claim 9, wherein said motor comprises an electric motor having an armature shaft, and said drive pulley is mounted on said shaft.

11. The power tool of claim 10, wherein said fan is mounted on said shaft between said drive pulley and said motor.

12. The power tool of claim 11, wherein said fan comprises a disk with fan blades upon a face thereof, and a partition partially covering said fan blades is disposed between said fan and said drive pulley.

13. The power tool of claim 9, wherein:

said fan comprises a disk having fan blades on one side, an opposite side of said disk having concentric ridges extending therefrom;

said intermediate portion is of cup-like form having concentric ridges extending from a base thereof, said fan being disposed inside said cup-like form juxtaposed said base; and said concentric ridges on said disk mesh with said concentric ridges of said base.

14. The power tool of claim 13, wherein said base has a central aperture therein through which extends a shaft of said fan, and said cup-like form is of volute from with respect to said aperture.

15. The power tool of claim 9, wherein said fan and said drive pulley are integrally formed, said fan comprising a disk having fan blades extending therefrom, and said fan blades are disposed between said disk and said drive pulley.

16. A portable power file, comprising:

a housing having a handle portion;

a motor in said housing;

a drive pulley rotatably drivable by said motor;

an idler pulley rotatably mounted on one end of an arm assembly extending away from said drive pulley;

an abrasive belt trained around and extending between said drive and idler pulleys;

a passageway extending through said housing, said passageway being open to atmosphere at one end and terminating at an opposite end beyond said drive pulley in an air outlet;

means for inducing a flow of air through said passageway from said one end to said opposite end, said drive pulley being disposed in said flow of air;

a bag pervious to passage of air but impervious to passage of debris to be collected in use therein, the bag having a debris inlet communicating with said air outlet;

an inner support member disposed inside said bag and an outer support member secured to said inner support member;

an upper edge of the bag being located between said inner and outer support members;

said outer support member having a mouth portion with an orifice therein communicating with said debris inlet of the bag, a support bar extending from said mouth portion between said bag and said handle portion, and said mouth portion engaging and communicating with said air outlet; and means for releasably attaching said support bar to said handle portion.

17. The power file of claim 16, wherein said inner support member has a mouth aligned with said debis inlet.

18. The power file of claim 16, wherein said outer support member and said inner support member are formed with interengaging means for locating said members with respect to one another and for holding them together.

19. The power file of claim 18, wherein said interengaging means includes apertures in one of said members and studs on the other of said members, the studs engaging in the apertures to locate the one member with respect to the other; and said outer support member has extensions by which an assembly of said bag and said members is secured to said housing.

20. A portable power file, comprising:

a housing having a front, a rear closed handle, a motor compartment extending transversely to said handle between said front and said handle, and a bottom portion below said handle and having a rear wall adjacent but below said handle;

said front having an air inlet opening therein;

said rear wall of said bottom portion having an air outlet therein;

a passageway extending from said air inlet opening to said air outlet;

a guide located in said passageway;

an arm assembly extending forwardly from said guide, through said air inlet opening and forwardly of said housing, a rear end of said arm assembly being slidably supported by said guide;

an idler pulley rotatably mounted on a forward end of said arm assembly;

an electric motor disposed in said motor compartment and having a drive shaft;

a drive pulley and a fan both mounted on said shaft to be drivingly rotated thereby;

said drive pulley and said fan both being located in said passageway, said fan in use creating an air flow by drawing air in through said inlet opening and discharging the air through said outlet, said pulley being disposed in said air flow;

an abrasive belt trained over and extending between said pulleys, two flights of said belt passing through said inlet opening with a space remaining above and below the two flights for passage of said air;

a dust bag assembly removably connected to said air outlet for collection of debris created in use by said abrasive belt and entrained in said airflow;

said dust bag assembly comprising a bag attached to an external frame member;

said external frame member extending along a top of the bag and being disposed between the bag and a bottom wall of said handle; and interengaging means for releasably connecting said frame member to said handle by effecting detachable interengagement between said frame member and said bottom wall of said handle.

* * * * *